United States Patent [19]

Helling et al.

[11] Patent Number: 4,950,039

[45] Date of Patent: Aug. 21, 1990

[54] MULTIPLE-SHELF STORAGE CONTAINER FOR THIN FLEXIBLE STACKABLE ARTICLES

[76] Inventors: Robert W. Helling, 11214 Quivas Way, Westminster, Colo. 80234; Daniel J. Helling, 8288 Pecos St., Denver, Colo. 80221

[21] Appl. No.: 402,624

[22] Filed: Sep. 5, 1989

[51] Int. Cl.[5] ..... A47B 81/00

[52] U.S. Cl. ..... 312/20; 312/344.1

[58] Field of Search ..... 312/20, 12, 341.1, 344.1, 312/343, 347; 206/387

[56] References Cited

U.S. PATENT DOCUMENTS

| | | | |
|---|---|---|---|
| 2,258,667 | 10/1941 | Wogulis | 312/343 |
| 2,576,407 | 11/1951 | McDowell | 312/350 X |
| 2,682,754 | 7/1954 | Eck | 312/350 X |
| 2,751,272 | 6/1956 | Hutzelman | 312/350 X |
| 2,757,051 | 7/1956 | Wilmer et al. | 312/344 X |
| 3,550,978 | 12/1970 | Magee | 312/350 X |
| 3,649,090 | 3/1972 | Dutot | 312/344 X |
| 3,679,274 | 7/1972 | Nance | 312/344 X |
| 3,826,550 | 7/1974 | Propst et al. | 312/350 X |
| 4,702,369 | 10/1987 | Philosophe | 312/12 |

*Primary Examiner*—Joseph Falk

*Attorney, Agent, or Firm*—Fields, Lewis, Pittenger & Rost

[57] ABSTRACT

A multiple-shelf storage container disclosed has a pair of opposed shelf-supporting, lightweight inner side panels with each made of a thin, molded plastic, one-piece body and a plurality of lightweight shelves made of a material similar to the side panels and supported by shelf-supporting wall portions of the side panels to slide between retracted and extended positions. The inner side panels are preferably mounted to the inside of side walls of a box-like outer shell. Each shelf has a recessed portion in the shape of the article being supported to enable a stack of the articles to be supported thereon. The shelves move to an extended position for displaying and access to the supported articles such as thin film balloons.

16 Claims, 3 Drawing Sheets

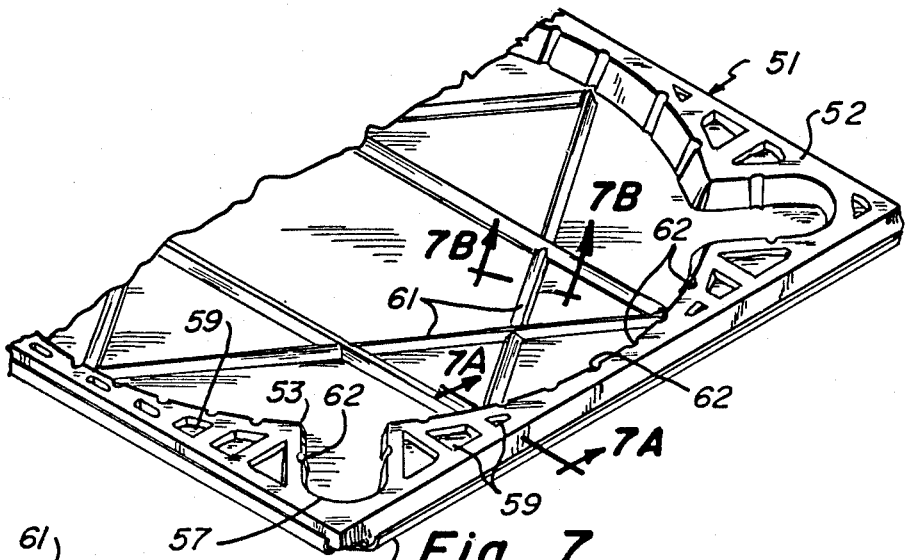
Fig_7
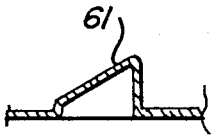
Fig_7B
Fig_7A
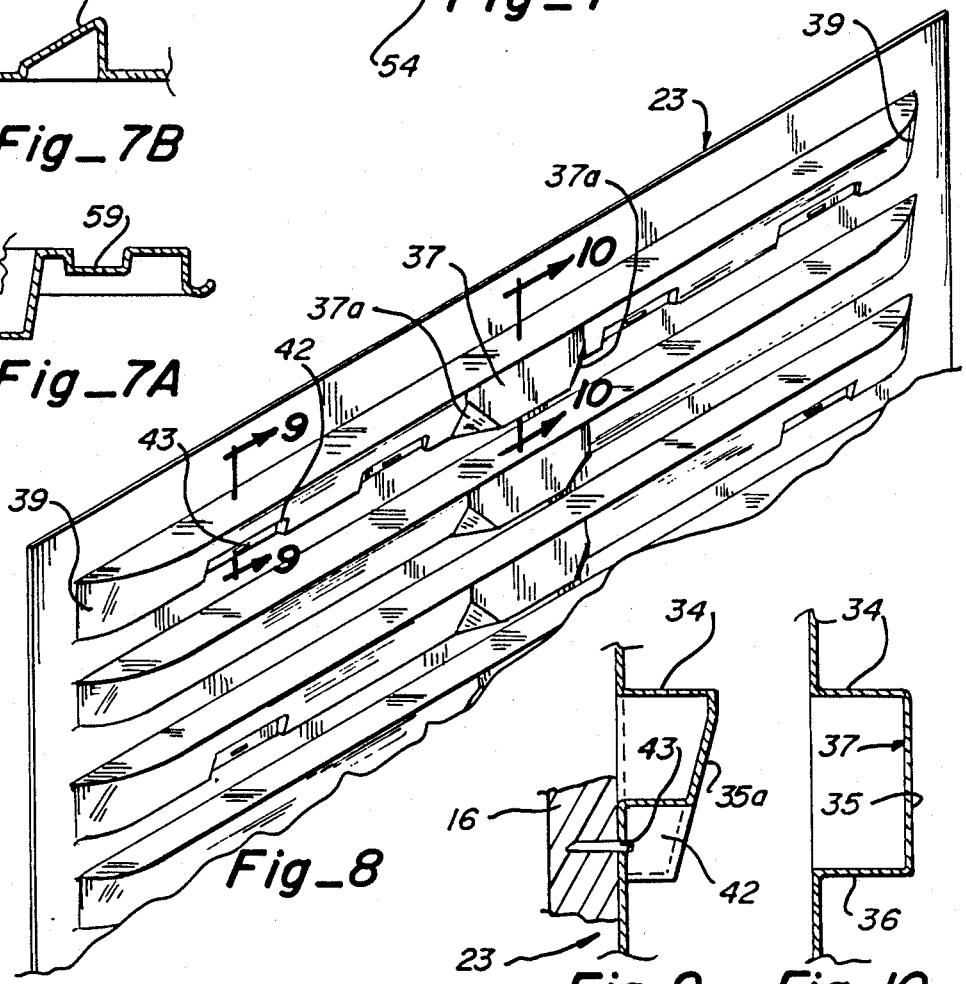
Fig_8
Fig_9
Fig_10

MULTIPLE-SHELF STORAGE CONTAINER FOR THIN FLEXIBLE STACKABLE ARTICLES

TECHNICAL FIELD

This invention relates to a novel and improved storage container, that is particularly suitable for storing and readily accessing a plurality of thin flexible stackable articles such as film balloons and the like.

BACKGROUND ART

There are numerous thin flexible articles such as film balloons that are relatively thin and have no rigidity and are hard to store in such a way as to be readily accessed, viewed and delivered to a customer are a point of sale. Currently available storage containers have the disadvantage of being too heavy, too costly, too cumbersome and have shelves with planar top surfaces that do not prevent a plurality of stacked articles supported thereon from sliding from side to side relative to one another.

DISCLOSURE OF THE INVENTION

A lightweight multi-shelf storage container has a pair of opposed, shelf-supporting inner side panels with sets of shelf support portions slidably supporting a plurality of vertically spaced shelves. Each shelf has a recessed portion in the shape of an article being stored to receive and retain in place a plurality of stacked articles. The inner side panels and shelves preferably are made of a thin, substantially rigid, molded, one-piece plastic body such as PVC, ABS or the like.

BRIEF DESCRIPTION OF THE DRAWINGS

FIG. 7 is a top perspective view of an enlarged portion of one of the shelves shown in FIG. 2.

FIG. 7A is a sectional view taken along line 7A—7A of FIG. 7.

FIG. 7B is a sectional view taken along line 7B—7B of FIG. 7.

FIG. 8 is a perspective view of an enlarged upper portion of one of the inner side panels.

FIG. 9 is a sectional view taken along line 9—9 of FIG. 8.

FIG. 10 is a sectional view taken along line 10—10 of FIG. 8.

DETAILED DESCRIPTION

Figure 1:
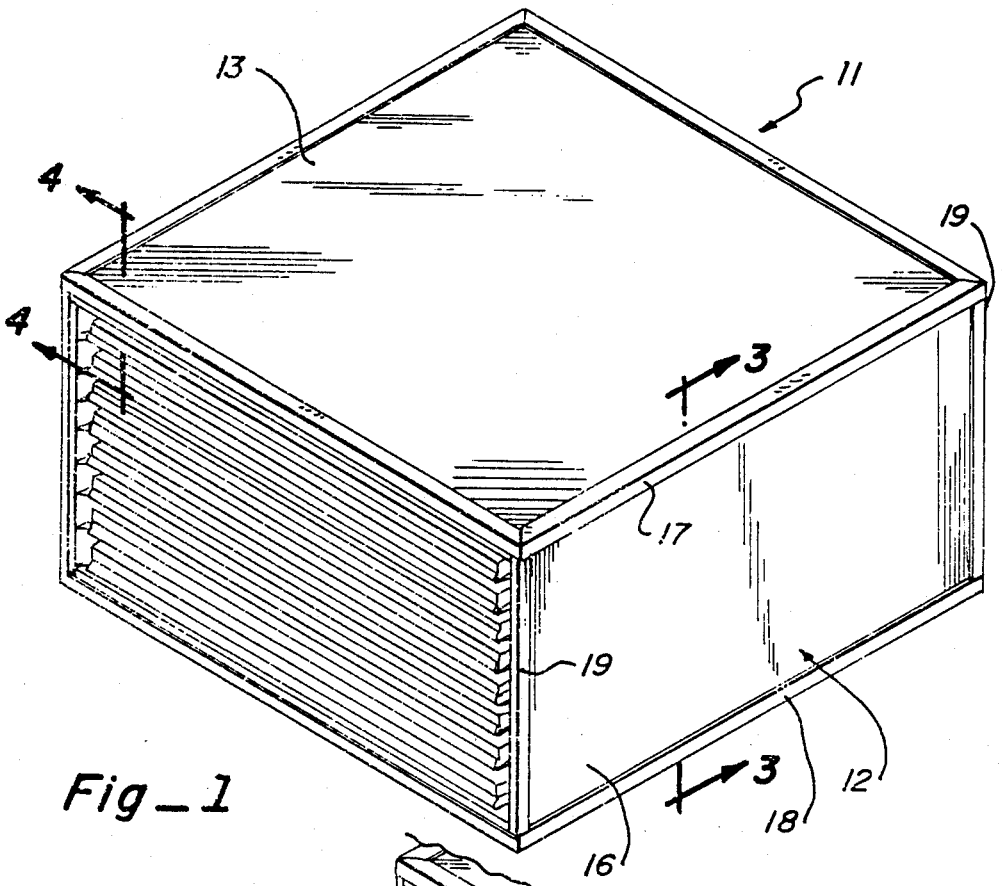
FIG. 1 is a top perspective view of a container embodiment features of the present invention.

Referring now to the drawing, there is shown a container 11 embodying features of the present invention including a box-shaped outer shell 12 having a flat top panel 13, a flat bottom panel 14, a flat back panel 15 and opposed, spaced outer side panels 16 with the shell being open at the front. The panels 13, 14, and 15 are preferably made of a thin, flat, lightweight sheet material such as plastic, pressed board, wood or the like and may have a grain and/or selected color for a good appearance. A top corner molding 17 of a molded plastic or the like is shown provided around the top of the outer shell and a bottom corner molding 18 is provided around the bottom of the outer shell. An edge molding 19 is shown fitted over each front and rear edge of the side panels.

A pair of oppositely disposed and spaced apart inner side panels 23 are mounted on the inside of associated of the outer side panels 16 and are held a fixed distance apart by a pair of front and rear transverse top braces 25 and a pair of front and rear transverse bottom braces 26. The braces may be fastened as by an adhesive or by screws threaded through from the outside of the outer side panels of shell 12.

Figure 2:
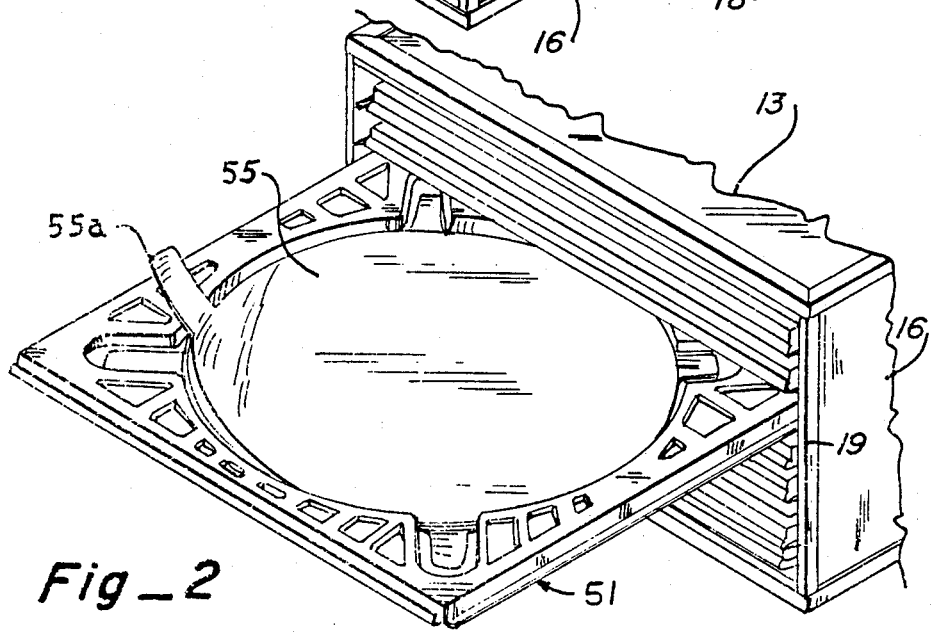
FIG. 2 is a partial top perspective of the container shown in FIG. 1 with one of the shelves moved to an extended position to display the articles and make them available for removal.
Figure 3:
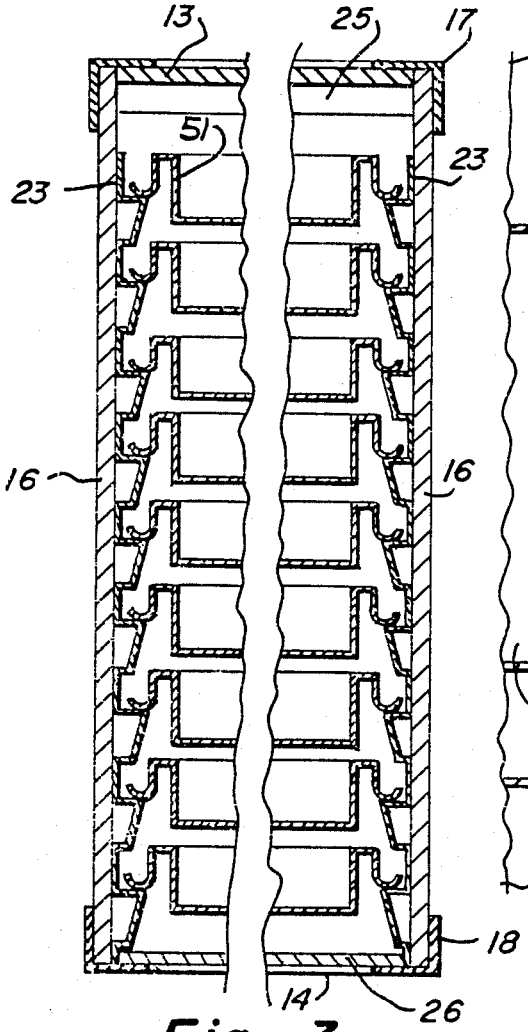
FIG. 3 is a sectional view taken along lines 3—3 of FIG. 1.
Figure 5:
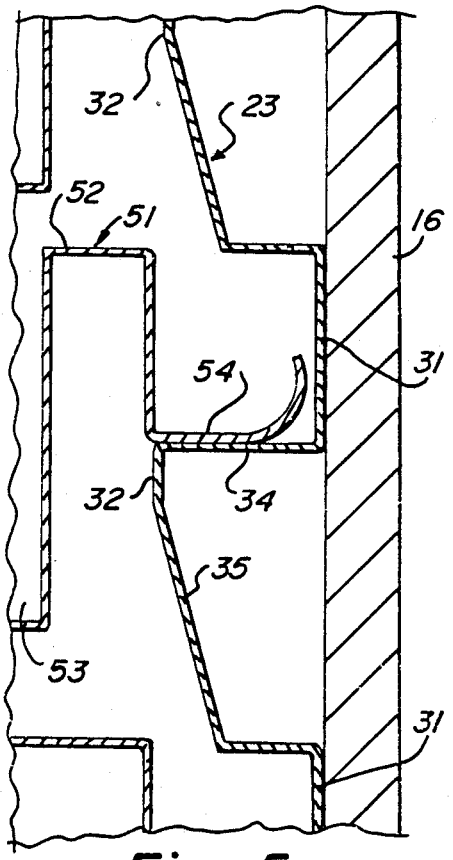
FIG. 5 is an enlarged sectional view of a portion of FIG. 3.
Figure 4:
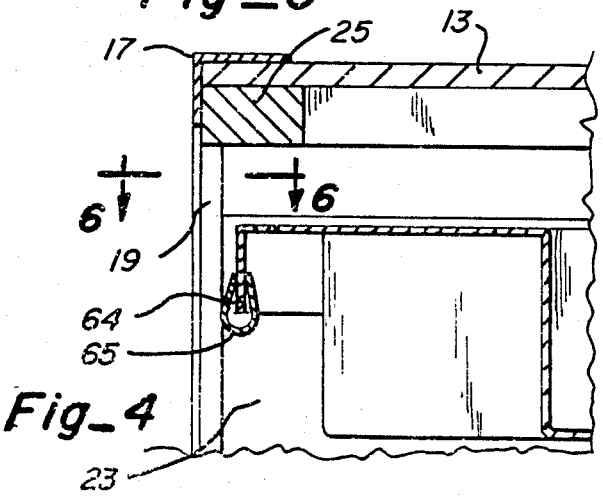
FIG. 4 is a sectonial view taken along line 4—4 of FIG. 1.
Figure 6:
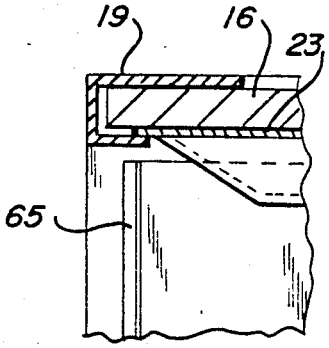
FIG. 6 is a sectional view taken along line 6—6 of FIG. 4.

Referring now to FIG. 5, the inner side panels 23 have a substantially flat or planar main body portion 31 that butts against the inside of an associated outer side panel 16 and a series of elongated, vertically spaced, inwardly extending, channel-like protruding wall portions 32. Each channel-like protruding wall portion 32 has a horizontal inner wall section 34 serving as a shelf support portion, an inner sidewall section 35 that is the base of the channel shape and a horizontal lower wall section 36 opposite and spaced from the upper wall section 34. As seen in FIG. 8 an intermediate length segment 37 of each protruding wall portion midway between the ends has the lower wall section 36 horizontal disposed and wall section 35 parallel to portion 31 which serves to hold the next lower shelf to prevent undue tilting of the shelf when the self is moved to an extendend position as seen in FIG. 2.

The channel-like protruding wall portions 32 are further shaped with tapered or beveled front and rear end portion 39 and are further shaped with tapered sidewall sections 35*a* (FIG. 9) between the end portions 39 and intermediated segment 37. Intermediate segment 37 is also seen to have beveled or tapered front and rear end portions 37*a*. Each channel-like protruding wall portion 32 is further seen to have one or more longitudinally spaced recessed portions 42 which may received staples 43 to fasten each inner side panel 23 to the associated outer side panel 16. It is understood that alternative fasteners may be used including the use of an adhesive.

A plurality of shelves 51 are slidably supported by oppositely disposed sets of the shelf support portions 34 of the inner side panels. Each shelf 51 shown is of a generally square shape having a generally flat, main body portion 52, a recessed article support portion 53 within the main body portion and a pair of guide rail portions 54 along two opposite outer sides of the main body portion. Each recessed article support portion 53 has side wall extending down from portion 52 and a flat bottom wall. Each guide rail surface portion 54 is provided by a vertical segment depending down from the outer of the main body portion, a horizontal rail segment extending out from the bottom end of the vertical segment and an upturned curved end segment extending up from the outer end of the horizontal rail segment. The vertical segment extends to a point about midway between the ends of the sidewall of the recessed portion 53 to locate the horizontal rail segment approximately midway between the ends of the recessed portion 53. The shape of the recessed portion 53 shown is specifically adapted to accommodate a stack of thin film balloons 55. The recessed portion 53 shown is generally circular and has an outwardly extending ear-like projection 57 at each corner of the square shape which receives the inflating valve portion 55*a* of the flat balloon 55.

Each shelf further has ribs 59 of a generally rectangular cross section in the main body portion and ribs 61 of a generally triangular shaped cross section in the recessed portion. The ribs 59 are provided from the midpoint of the front of the shelf to the ear projections at substantially equal intervals for added strength while there are not as many along the side or back wherein the main body portion is narrower. The ribs 61 are in the shape of a 6 pointed star and there are ribs 62 in the sidewall of the recessed portion for additional strength. Each shelf further has a downturned lip 64 along the front edge on which there is a molding 65 for gripping by the user.

The side support panels and each shelf preferably are made of a rigid elastomeric material such as polyvinyl chloride (PVC) or acrylonitrile butadiene styrene (ABS) having a thickness of about 0.03 inches. These parts are preferably made using a vacuum mold process.

Although the present invention has been described with a certain degree of particularity, it is understood that the present disclosure has been made by way of example and that changes in details of structure may be made without departing from the spirit thereof.

What is claimed is:

1. A multiple-shelf storage container for a plurality of thin, flexible stackable article and the like comprising:

a pair of oppositely disposed upright, shelf-supporting side panels spaced a selected distance apart, each said side panel being in the form of a relatively thin, substantially rigid, molded, one-piece plastic body, said side panels having a plurality of vertically spaced, opposed, sets of inwardly protruding shelf support portions with each said set being disposed at substantially the same elevation, and a plurality of shelves supported at selected elevations between said side panels by said shelf support portions, each said shelf being in the form of a relatively thin, substantially rigid, molded, one-piece plastic body, each said shelf having oppositely disposed edge portions supported on an associated set of said shelf support portions for slidable movement thereon between extended and retracted positions, each said shelf having a recessed portion of a selected shape substantially conforming with the shape of a stack of thin flexible articles to be supported thereon whereby a number of said articles can be stored and selectively retrieved from selected of said shelves, each said sheld including a generally flat, main body portion providing a top surface, said recessed portion being within said main body portion said recessed portion having a side section extending down from said main body portion and a bottom section extending inwardly from the lower end of said side wall section, there being a pair of guide rail surface portions along opposite outer side edges of said main body portion, said guide rail surface portions of each shelf being slidable on an associated set of said shelf support portions, said guide rail surface portions being provided by a vertical segment depending from the outer edge of said main body portion, a horizontal rail segment extending out from the bottom end of said vertical segment, and an upturned curved end segment extending up from the outer end of said horizontal rail segment.

2. A container as set forth in claim 1 wherein each said side panel has a substantially flat, main body portion and a plurality of vertically spaced, elongated, inwardly protruding channel portions with an upper horizontal section of each said channel portions defining one of said shelf support portions.

3. A container as set forth in claim 2 wherein each said channel portion has a lower horizontal section to prevent a partially removed shelf on the next lower shelf segment portion from excessive downward tilting.

4. A container as set forth in claim 2 wherein said inwardly protruding channel portions have beveled front and rear end portions.

5. A container as set forth in claim 2 wherein said inwardly protruding channel portion has a tapered side section between upper and lower sections.

6. A container as set forth in claim 5 wherein said channel portion has an intermediate segment with a side section perpendicular to the top and bottom sections, said intermediate segment having tapered end portions.

7. A container as set forth in claim 2 wherein said inwardly protruding channel portion has at least one recessed portion to receive fasteners.

8. A container as set forth in claim 1 wherein said side panels and shelves are vacuum molded and are of a substantially uniform thickness throughout.

9. A container as set forth in claim 1 wherein said side panels and shelves are made of polyvinyl chloride and have a thickness of about 0.03 inches throughout.

10. A container as set forth in claim 1 including an outer shell having a top wall, spaced side walls, a bottom wall and a back wall, said side panels being secured to the inside of associated said side walls.

11. A container as set forth in claim 10 wherein said side walls are held a fixed distance apart by a pair of front and rear top braces and a pair of front and rear bottom braces.

12. A container as set forth in claim 1 wherein each shelf has a depending front edge portion projecting down from said main body portion along the front to be grasped by the user to move the shelf relative to said side panels.

13. A container as set forth in claim 1 wherein said main body portion has a series of reinforcing ribs molded therein.

14. A container as set forth in claim 1 wherein said recessed portion has a side wall section and a bottom wall section, said side wall sections having a series of spaced reinforcing ribs and said bottom wall sections having reinforcing ribs in the shape of a six pointed star.

15. A container as set forth in claim 1 wherein said shelf is substantially square and each recessed portion is generally circular having a radially extending ear portion at each corner to receive the inflating stem of a balloon.

16. A multiple-shelf storage container for a plurality of thin, flexible stackable articles such as film balloons comprising:

an outer shell having a top wall, spaced side walls, a bottom wall, a back wall and open at the front, a pair of oppositely disposed upright, shelf-supporting side panels mounted to the inside of said side walls, each said side panel being in the form of a relatively thin, substantially rigid, molded, one-piece plastic body, said side panels having a plurality of vertically spaced, opposed, sets of inwardly protruding shelf support portions with each said set being diposed at substantially the same elevation, each said side panel having a substantially flat, main body portion and a plurality of vertically spaced, elongated, inwardly protruding channel portions with an upper horizontal section of each of said channel portions defining one of said shelf support portions, each said channel portion having a lower section to prevent a partially removed lower shelf on the next lower shelf support portion from excessive downward tilting, and a plurality of shelves supported at selected elevations between said side panels by said shelf support portions, each said shelf being in the form of a relatively thin, substantially rigid, molded, one-piece plastic body, each said shelf having oppositely disposed edge portions supported on an associated set of said shelf support portions for slidable movement thereon between extended and retracted positions, each said shelf having a recessed portion of a selected shape substantially conforming with the shape of a stack of thin flexible articles to be supported thereon whereby a number of said articles can be stored and selectively retrieved from selected of said shelves, each said shelf including a generally flat, main body portion, said recessed portion being within said main body portion, there being a pair of guide rail surface portions along opposite outer side edges of said main body portion, said guide rail surface portions of each shelf being slidable on an associated set of said shelf support portions, each said shelf having a depending front edge portion projecting down from said main body portion along the front to be grasped by the user to move the shelf relative to said side panels, each said shelf including a generally flat, main body portion providing a top surface, said recessed portion being within said main body portion, said recessed portion having a side section extending down from said main body portion and a bottom section extending inwardly from the lower end of said side wall section, there being a pair of quide rail surface portions along opposite outer side edges of said main body portion, said guide rail surface portions of each shelf being slidable on an associated set of said shelf support portions, said guide rail surface portions being provided by a vertical segment depending from the outer edge of said main body portion, a horizontal rail segment extending out from the bottom end of said vertical segment, and an upturned curved end segment extending up from the outer end of said horizontal rail segment.

* * * * *